US008850839B2

(12) United States Patent
Park et al.

(10) Patent No.: US 8,850,839 B2
(45) Date of Patent: Oct. 7, 2014

(54) REFRIGERATOR

(75) Inventors: Kyoung Sun Park, Hwaseong-si (KR); Sang Gyu Jung, Gwangju-gu (KR); Jong Hoon Oh, Gwangsan-gu (KR); Sung Cheul Park, Gwangsan-gu (KR); Young Kil Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 630 days.

(21) Appl. No.: 13/064,970

(22) Filed: Apr. 28, 2011

(65) Prior Publication Data

US 2012/0047934 A1 Mar. 1, 2012

(30) Foreign Application Priority Data

Aug. 26, 2010 (KR) ..... 10-2010-0082936

(51) Int. Cl.

| | |
|---|---|
| ***F25D 23/12*** | (2006.01) |
| ***F25D 17/06*** | (2006.01) |
| ***F25D 25/02*** | (2006.01) |
| ***F25D 27/00*** | (2006.01) |
| *F25D 23/06* | (2006.01) |

(52) U.S. Cl.

CPC ..... *F25D 25/02* (2013.01); *F25D 23/067* (2013.01); *F25D 17/062* (2013.01); *F25D 27/00* (2013.01); *F25D 2325/022* (2013.01)

USPC ..... 62/262

(58) Field of Classification Search

USPC ..... 62/264, 407, 440, 441, 447

See application file for complete search history.

(56) References Cited

U.S. PATENT DOCUMENTS

| | | | | |
|---|---|---|---|---|
| 8,015,839 | B2 * | 9/2011 | Kang et al. | 62/408 |
| 2010/0024463 | A1 * | 2/2010 | Park | 62/340 |

* cited by examiner

*Primary Examiner* — Melvin Jones

(74) *Attorney, Agent, or Firm* — Staas & Halsey LLP

(57) ABSTRACT

A refrigerator including support ribs provided on both side walls of storage chambers so as to support both sides of shelves, each of which includes a tempered glass panel on which food is placed, and stopper members provided at both sides of the lower surface of the tempered glass panel, each support rib including a front rib, a rear rib, and a latch groove provided between the front rib and the rear rib such that each stopper member is inserted into the latch groove, and inclination prevention ribs, each of which is provided above the rear rib and supports the upper surface of each shelf, thereby improving assembly efficiency and productivity.

17 Claims, 16 Drawing Sheets

REFRIGERATOR

CROSS-REFERENCE TO RELATED APPLICATIONS

This application claims the priority benefit of Korean Patent Application No. 2010-0082936, filed on Aug. 26, 2010 in the Korean Intellectual Property Office, the disclosure of which is incorporated herein by reference.

BACKGROUND

1. Field

Embodiments relate to a refrigerator with shelves.

2. Description of the Related Art

In general, a refrigerator is an apparatus which includes components of a refrigeration cycle, and supplies cool air generated by an evaporator of the refrigeration cycle to insides of storage chambers of the refrigerator so as to maintain the storage chambers in a low temperature state.

At least one shelf on which articles are placed is provided in the storage chamber of the refrigerator so as to efficiently utilize the inner space of the storage chamber.

Among various kinds of shelves, in order to observe positions of articles and to support heavy articles for user convenience, a shelf including a transparent tempered glass panel, a trim part surrounding the edge of the tempered glass panel, and stoppers molded integrally with the trim part has been disclosed.

Further, beads to support the shelf are provided on both side walls of the storage chamber, and separate hook structures to prevent the shelf seated on the beads from being inclined forward is formed on the shelf.

SUMMARY

Therefore, it is an aspect to provide a shelf of a refrigerator which improves assembly efficiency and reduces material costs.

It is another aspect to provide a heater support structure of a refrigerator which prevents degradation and carbonization of peripheral structures around a heater of an evaporator.

It is another aspect to provide a cool air duct of a refrigerator which improves aesthetics and assembly efficiency.

It is a further aspect to provide a gasket assembly structure of a refrigerator which improves the exterior of a drawer slidably mounted in a storage chamber.

Additional aspects of the invention will be set forth in part in the description which follows and, in part, will be apparent from the description, or may be learned by practice of the invention.

In accordance with one aspect, a refrigerator includes a main body provided with an inner case forming storage chambers therein, doors to open and close the storage chambers, shelves, each of which includes a tempered glass panel on which food is placed, and stopper members provided at both sides of the lower surface of the tempered glass panel, support ribs provided on both side walls of the storage chambers so as to support both sides of the shelves, each support rib including a front rib, a rear rib, and a latch groove provided between the front rib and the rear rib such that each stopper member is inserted into the latch groove, and inclination prevention ribs, each of which is provided above the rear rib and supports the upper surface of each shelf to prevent each shelf seated on the support ribs from being inclined forward.

The length of the latch groove may be greater than the width of the stopper members so as to allow each stopper member to move forward and backward within the latch groove.

If each stopper member moves to a front end of the latch groove, the corresponding shelf may be separable from the support ribs, and if each stopper member moves to a rear end of the latch groove, the rear end of the corresponding shelf may be supported by the inclination prevention ribs and thus the corresponding shelf may be mounted in the storage chamber.

The refrigerator may further include an illumination unit including a light source to illuminate each storage chamber and a transparent cover to transmit light emitted from the light source, and reflectors formed through an ultraviolet curable printing method may be provided on the transparent cover.

The refrigerator may further include an evaporator generating cool air to supply the cool air to each storage chamber, and a defrost heater to remove frost formed on the evaporator, a heater cover installed on the inner case to block heat generated by the defrost heater, and a separation member to separate the heater cover from the inner case so as to prevent carbonization of the inner case caused by the heater cover may be provided.

The stopper members may be fixed to the tempered glass panel through an adhesive agent.

Each shelf may further include a front frame made of resin and surrounding the front edge of the tempered glass panel, and the surface of the front frame may be coated with a film made of metal.

The front frame may be made of Acrylonitrile Butadiene Styrene (ABS), and the film may be made of aluminum.

The refrigerator may further include an evaporator generating cool air to supply the cool air to each storage chamber and a cool air duct assembly to supply the cool air generated by the evaporator to each storage chamber, the cool air duct assembly may include an insulation pad provided with a channel, a front cover to cover the front surface of the insulation pad, an air blower fan disposed in the channel, and a mount part to fix the air blower fan may be formed integrally with the insulation pad.

The refrigerator may further include a sub-storage chamber disposed in one of the storage chambers such that the temperature of the sub-storage chamber is controlled independently of the one of the storage chamber, and the sub-storage chamber may include a housing forming a storage space and provided with an opening formed through the front surface thereof, and a drawer container to move forward and backward installed in the storage space so as to open and close the opening, and a gasket is provided around the opening.

The refrigerator may further include cool air outlets through which cool air generated by an evaporator of each storage chamber is discharged, and the cool air outlets may be configured such that the cool air discharged to each storage chamber through the cool air outlets is directed to the upper portions of each storage chamber.

Discharge channels, each of which is provided at the rear of each cool air outlet, may be inclined downward.

The refrigerator may further include a front cover provided with cool air outlets through which cool air generated by an evaporator of each storage chamber is discharged and discharge channels, each of which is provided at the rear of each cool air outlet, and the front cover may be provided with flanges which is bent so as to surround the front portions of the inner surfaces of the discharge channels.

Hook holes may be provided at both sides of the tempered glass panel, and the stopper members may be hooked to the hook hole and thus fixed to each shelf.

In accordance with another aspect, a refrigerator, which is provided with storage chambers, a receipt box installed on each storage chamber so as to be extended from and inserted into the inside of each storage chamber, and a cover contacting upwardly inclined surfaces of the upper ends of both side walls of the receipt box and rotated upward and downward about a rotary shaft so as to open the upper portion of the receipt box when the receipt box is extended from the inside of each storage chamber, and to close the upper portion of the front region of the receipt box when the receipt box is inserted into the inside of each storage chamber, includes buffering members to prevent noise generated due to collision of the cover with the receipt box when the cover is rotated downward so as to close the receipt box.

The buffering members may include pads made of an elastic material.

The buffering members may be located at positions where the cover and the receipt box contact each other.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
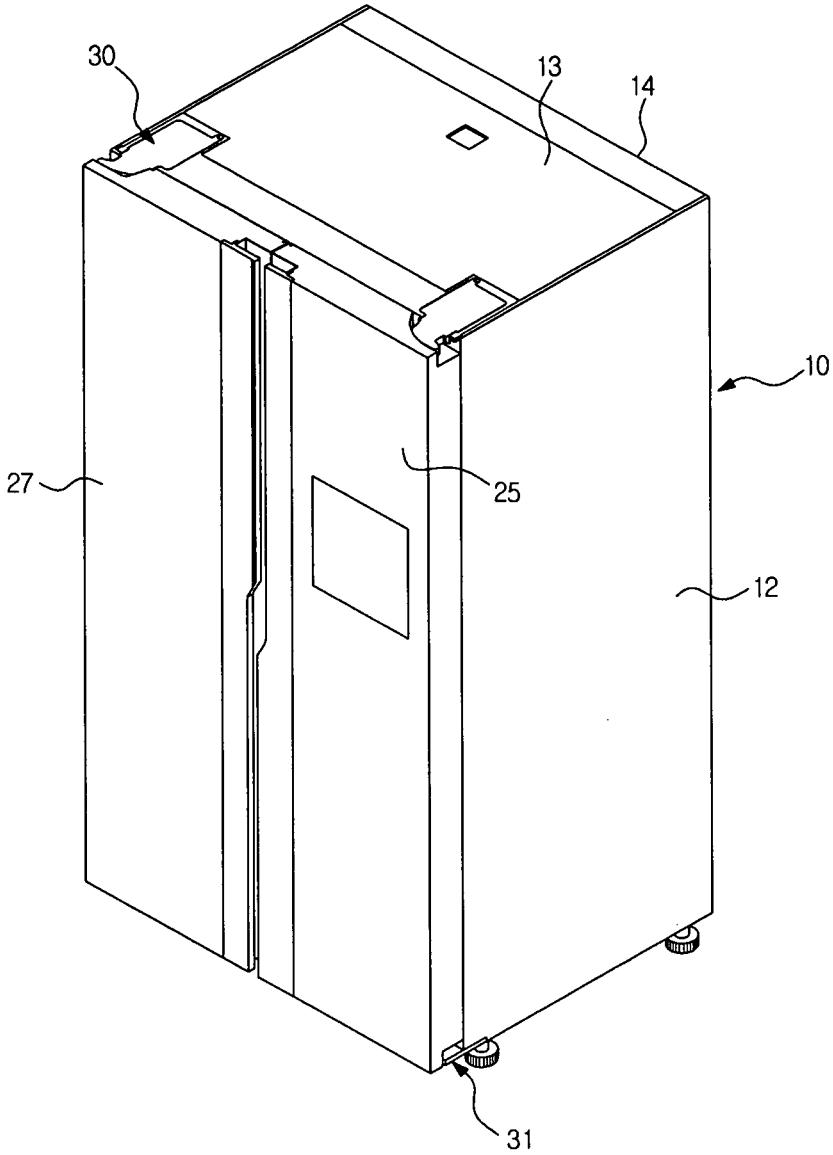
FIG. 1 is a perspective view illustrating the exterior of a refrigerator in accordance with one embodiment.

Reference will now be made in detail to the embodiments, examples of which are illustrated in the accompanying drawings, wherein like reference numerals refer to like elements throughout.

Figure 2:
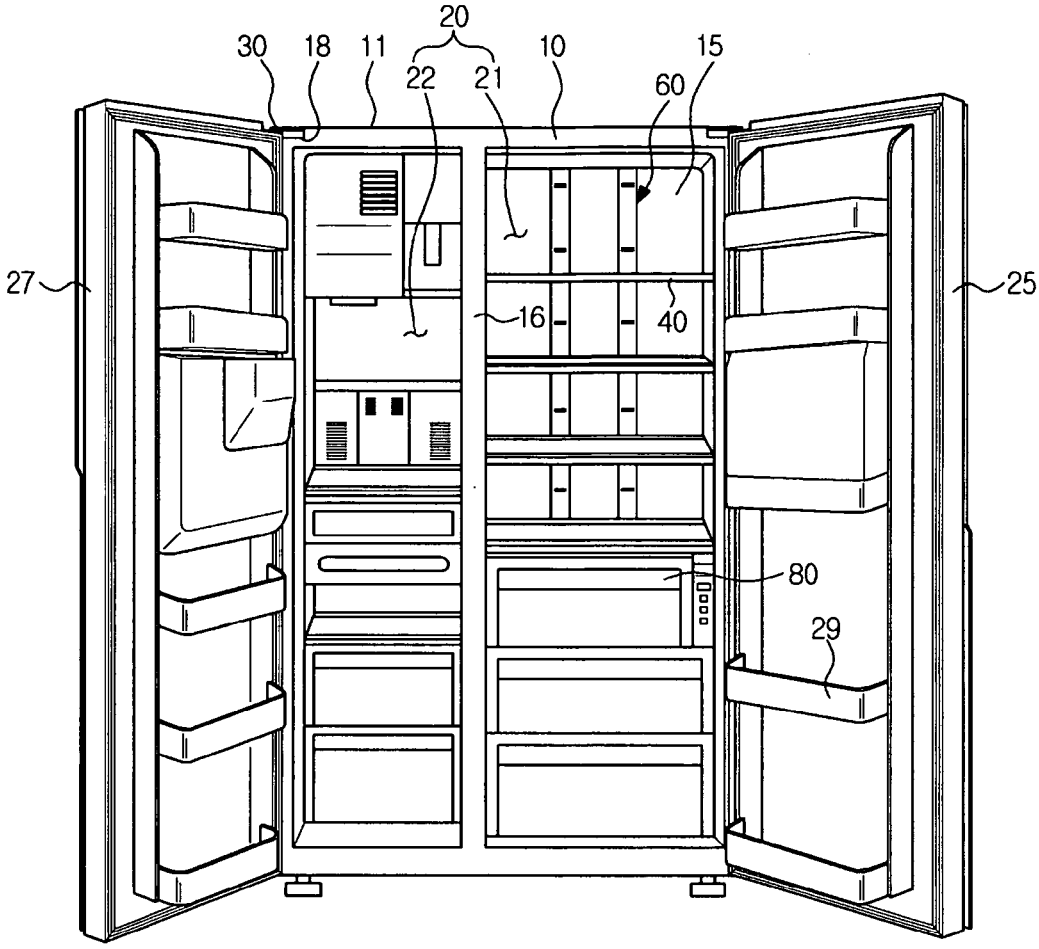
FIG. 2 is a perspective view illustrating a state in which of doors of the refrigerator in accordance with the embodiment are opened.

With reference to FIGS. 1 and 2, a refrigerator in accordance with one embodiment includes a main body 10 forming the exterior of the refrigerator and provided with a plurality of storage chambers 20 formed therein, and doors 25 and 27 rotatably installed on the main body 10 so as to open and close the storage chambers 20.

The main body 10 includes an outer case 11 forming the exterior of the main body 10, an inner case 15 installed within the outer case 11 and forming the plurality of storage chambers 20, a foaming agent 17 filling a space between the outer case 11 and the inner case 15, and a machinery room (not shown) to receive a plurality of electronic and electrical components.

The majority of the outer case 11 is made of metal in consideration of durability, and the inner case 15 is made of resin in consideration of a heat insulating function and convenience in manufacturing.

The outer case 11 includes a main frame 12 having a U shape to form lower and both side surfaces of the main body 10, an upper frame 13 connected to the upper portion of the main frame 12 to form an upper surface of the main body 10, and a rear frame 14 connected to the rear portion of the main frame 12 to form a rear surface of the main body 10.

The inside of the inner case 15 is divided into a first storage chamber 21 and a second storage chamber 22 by a vertical diaphragm 16 provided at the center of the inner case 15. Here, the first storage chamber 21 serves as a refrigerating chamber, and the second storage chamber 22 serves as a freezing chamber.

The doors 25 and 27 include a first door 25 to open and close the first storage chamber 21, and a second door 27 to open and close the second storage chamber 22. The first door 25 and the second door 27 are rotatably connected to the main body 10 through hinge units 30 and 31 disposed on the upper and lower surfaces of the main body 10.

The hinge units 30 disposed on the upper surface of the main body 10 are received in hinge receipt parts 18 depressed on the upper surface of the main body 10 so as not to be protruded outward from the upper surface of the main body 10. That is, the upper surfaces of the hinge units 30 are disposed to be coplanar with the upper surface of the main body 10, thereby improving the aesthetics of the exterior of the refrigerator.

Further, the hinge units 31 disposed on the lower surface of the main body 10 rotatably support the lower surfaces of the doors 25 and 27 through hinge brackets mounted on the lower surface of the main body 10. This reduces the thickness of the lower end of the main body 10, thereby increasing a volume of the storage chambers 20.

A plurality of door guards 29 to receive a small volume of food, is provided on the inner walls of the doors 25 and 27.

A plurality of shelves 40 vertically separated from each other is provided in the upper portion of the storage chamber 21, and a sub-storage chamber 80, the temperature of which is controlled separately from the storage chamber 21, is provided in the lower portion of the storage chamber 21.

Figure 3:
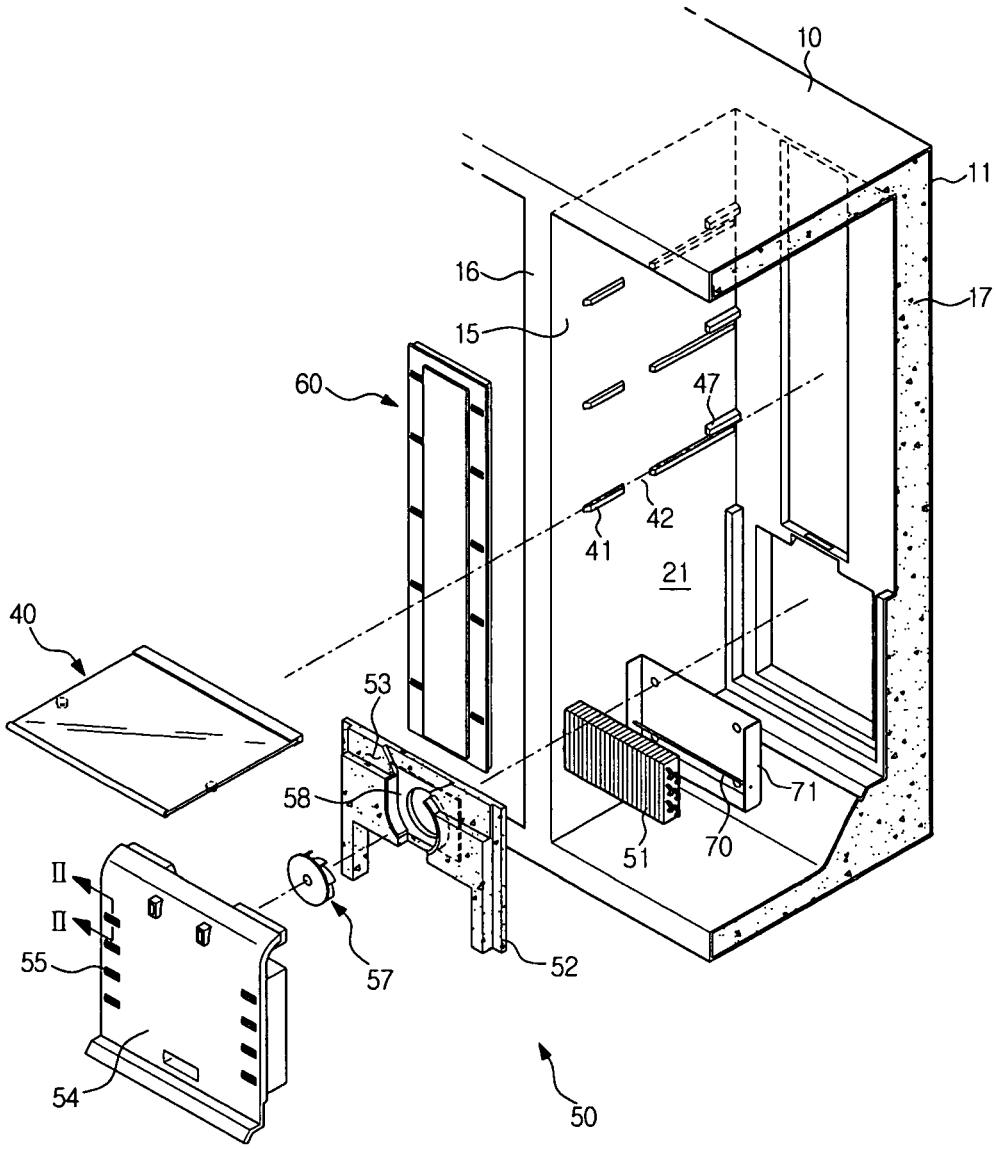
FIG. 3 is an exploded perspective view of the inside of a storage chamber in accordance with the embodiment.
Figure 4A:
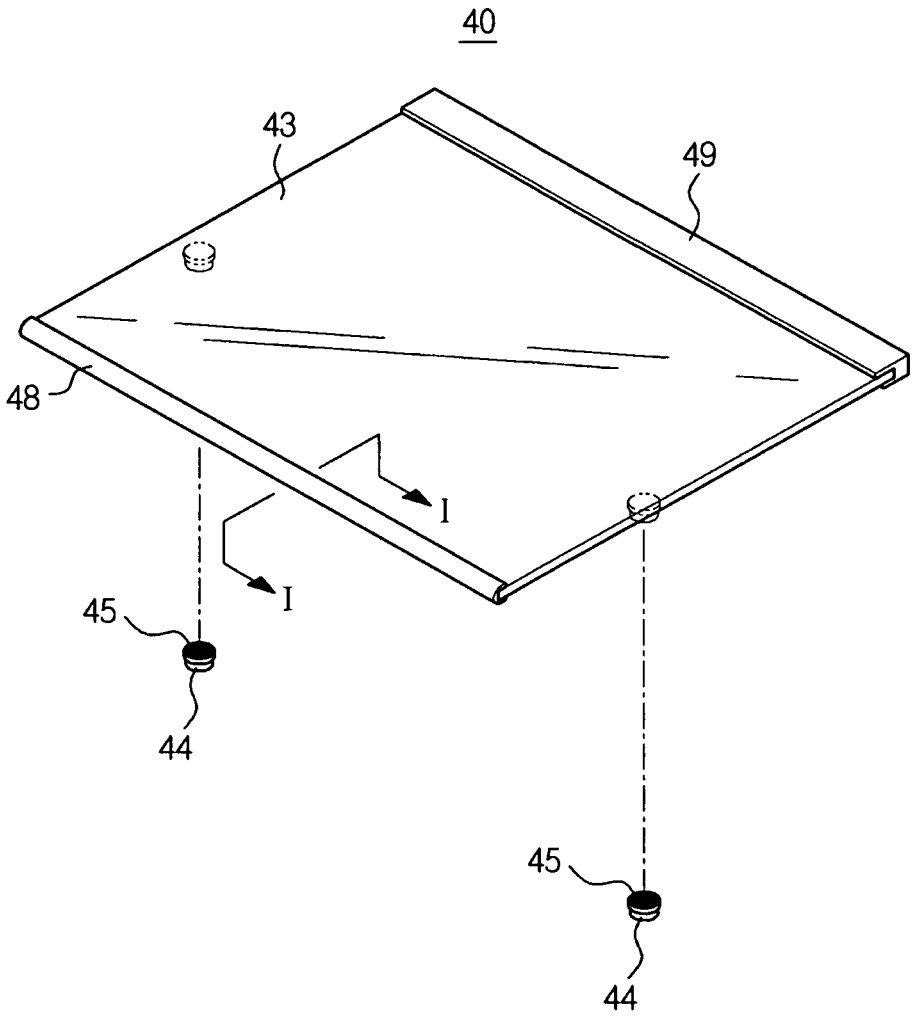
FIG. 4A is a perspective view of a shelf in accordance with the embodiment.

With reference to FIGS. 3 and 4A, a plurality of support ribs 41, which is protruded such that both side ends of the shelf 40 are respectively supported by the support ribs 41, is provided on both side walls of the storage chamber 21, and a latch groove 42, which is depressed, is provided at the middle portion of the support rib 41.

That is, the support rib 41 is divided into a front rib 41*a* and a rear rib 41*b*, separated from each other, by the latch groove 42. That is, the latch groove 42 is disposed between the front rib 41*a* and the rear rib 41*b*.

The shelf 40 includes a tempered glass panel 43, both side ends of which are seated on and supported by the support ribs 41 such that food is placed on the tempered glass panel 43, and stopper members 44 to restrict forward and backward movement of the tempered glass panel 43 when the tempered glass panel 43 is seated on the support ribs 41.

The stopper members 44 are disposed at positions of both sides of the lower surface of the tempered glass panel 43 corresponding to the latch grooves 42 provided on the support ribs 41.

The length of the latch grooves 42 is greater than the width of the stopper members 44 so as to allow the shelf 40 to be easily seated on and separated from the support ribs 41, and corresponds to the length L (FIG. 6B) of inclination prevention ribs 47, which will be described later. This serves to prevent the inclination prevention ribs 47 from interfering with rear end of the shelf 40 when the shelf 40 is separated from the support rib 41.

These stopper members 44 are directly fixed to the tempered glass panel 43 through an adhesive agent 45. Such a method does not require a separate processing operation of the tempered glass panel 43, thus forming the fine exterior of the tempered glass panel 43.

Figure 4B:
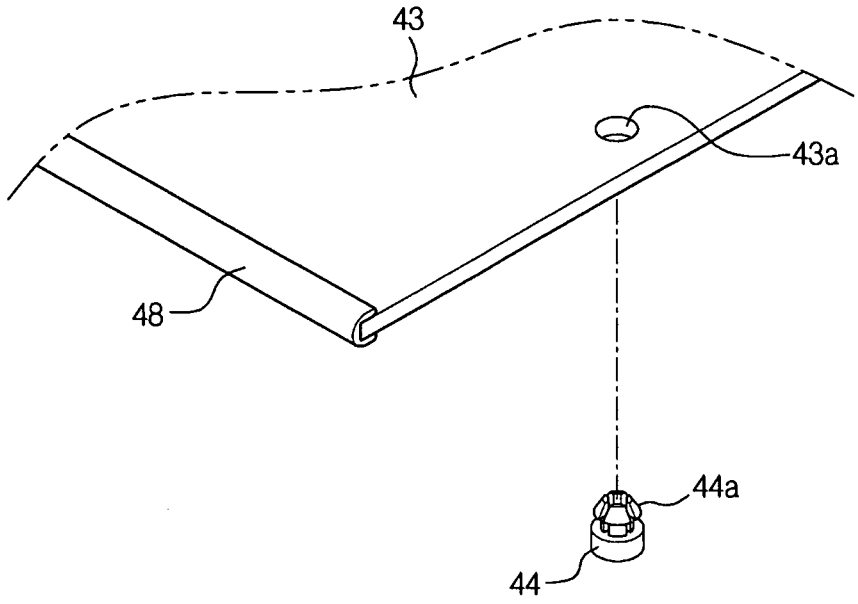
FIG. 4B is a perspective view of a shelf in accordance with another embodiment.

This embodiment describes that the stopper members 44 are fixed to the tempered glass panel 43 through the adhesive agent 45. However, as shown in FIG. 4B, separate hook holes 43*a* may be formed through both sides of the tempered glass panel 43, and the stopper members 44 may be provided with hook parts 44*a* hooked to the hook hole 43*a*. This method facilitates assembly and disassembly of the stopper members 44, thus improving workability.

Frames 48 and 49 surrounding the front and rear ends of the tempered glass panel 43 are provided with the shelf 40. The frames 48 and 49 include a front frame 48 surrounding the front end of the tempered glass panel 43 and a rear frame 49 surrounding the rear end of the tempered glass panel 43.

Figure 5:
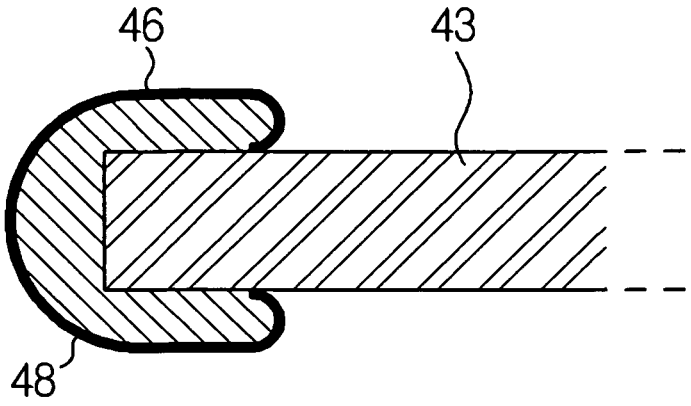
FIG. 5 is a longitudinal-sectional view taken along the line I-I of FIG. 4A.

Such frames 48 and 49 are made of resin, such as Acrylonitrile Butadiene Styrene (ABS). The outer surfaces of the frames 48 and 49 are coated with a film 46 made of metal, such as aluminum, as shown in FIG. 5. The film 46 may be formed on the frames 48 and 49 through insert molding when the frames 48 and 49 made of resin are molded.

These frames 48 and 49 improve productivity due to reduction of material costs, compared with conventional decorative frames made of aluminum or stainless steel.

Further, the frames 48 and 49 in accordance with this embodiment are not provided at both side ends of the tempered glass panel 43, thereby improving visibility and thus increasing the apparent volume of the storage chamber 21.

Figure 6A:
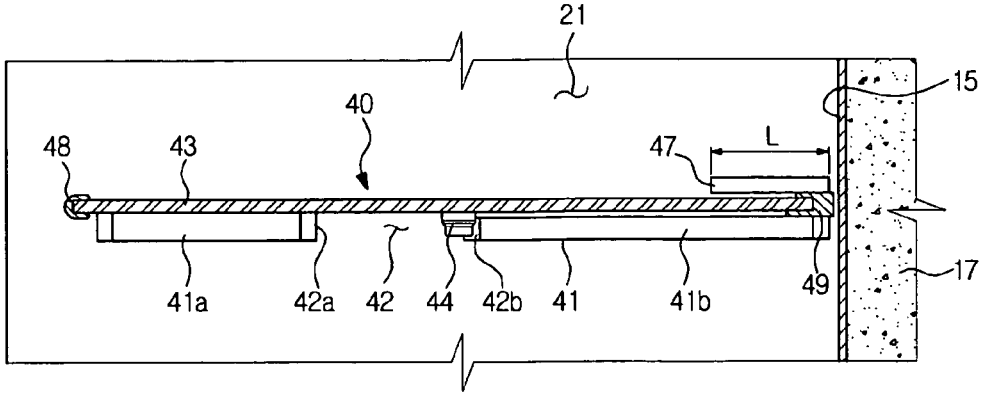
FIG. 6A is a longitudinal-sectional view illustrating a connection structure of the shelf mounted in the storage chamber in accordance with the embodiment.

With reference to FIGS. 3 and 6A, the inclination prevention ribs 47 to prevent the shelf 40 seated on the support ribs 41 from being inclined forward are provided at the rear portions of both side walls of the storage chamber 21.

The inclination prevention ribs 47 are separated from the support ribs 41 so as to support the upper surface of the rear portion of the shelf 40 seated on the support ribs 41, and are protruded from the side walls of the inner case 15.

The inclination prevention ribs 47 are provided above the rear ribs 41*b*, and the rear end of the shelf 40 is inserted into spaces between the rear ribs 41*b* and the inclination prevention ribs 47.

In order to mount the shelf 40 in the storage chamber 21, when the stopper members 44 are inserted into the latch grooves 42 and then the shelf 40 is pushed into the storage chamber 21, the stopper members 44 are moved to rear end 42*b* of the latch grooves 42, and simultaneously, the rear end of the shelf 40 is inserted into the spaces between the rear ribs 41*b* and the inclination prevention ribs 47.

In this case, even if food is placed on the shelf 40, the rear end of the shelf 40 is supported by the inclination prevention ribs 47 and thus forward inclination of the shelf 40 is prevented.

Figure 6B:
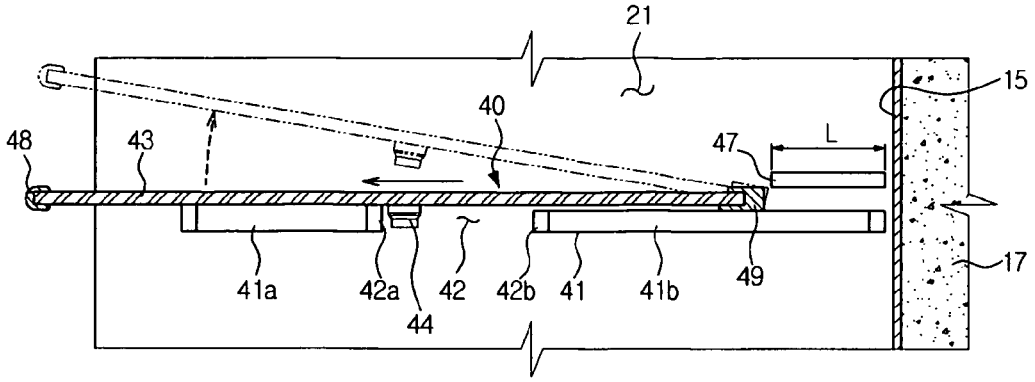
FIG. 6B is a longitudinal-sectional view illustrating a separating operation of the shelf in accordance with the embodiment.

On the other hand, in order to separate the shelf 40 from the storage chamber 21, when the shelf 40 is pulled forward, the stopper members 44 are moved to the front end 42*a* of the latch grooves 42, and simultaneously, the rear end of the shelf 40 is separated from the inclination prevention ribs 47, as shown in FIG. 6B. Thereafter, when the shelf 40 is lifted upward, the shelf 40 is separated from the support ribs 41.

Through such a configuration, the shelf 40 does not require a separate support structure to prevent the shelf 40 from being inclined forward when food is placed on the shelf 40, and thus a mold for the shelf 40 has a simple structure, thereby reducing material costs of the shelf 40.

With reference to FIG. 3, an evaporator 51 connected with a refrigeration cycle and forming a closed circuit together with the refrigeration cycle to generate cool air and a cool air duct assembly 50 to supply the cool air generated by the evaporator 51 to the storage chamber 21 are provided at the rear portion of the storage chamber 21.

The cool air duct assembly 50 includes an insulation pad 52 provided with a channel 53 to supply the cool air generated by the evaporator 51 to the storage chamber 21 or to inhale cool air from the storage chamber 21, and a front cover 54 made of resin to cover the front portion of the insulation pad 52.

An air blower fan 57 to forcibly blow cool air to the storage chamber 21 is provided in the channel 53. The air blower fan 57 is installed at a mount part 58 formed integrally with the insulation pad 52.

The air blower fan 57 is a centrifugal fan integrated with a motor, and is installed at an upstream portion of the channel 53 of the insulation pad 52.

The mount part 58 is a plate made of resin to fix the air blower fan 57, and is formed integrally with the insulation pad 52 through insert molding when the insulation pad 52 is molded.

The insulation pad 52 is made of a foamed insulation material so as to reduce a heat loss of the cool air. For example, the insulation pad 52 may be made of polyethylene foam.

Through such a configuration, assembly efficiency and productivity of the cool air duct assembly 50 are improved due to reduction of the number of parts of the cool air duct assembly 50.

Cool air outlets 55 through which the cool air generated by the evaporator 51 is discharged to the storage chamber 21 are provided at both sides of the front cover 54.

Figure 7A:
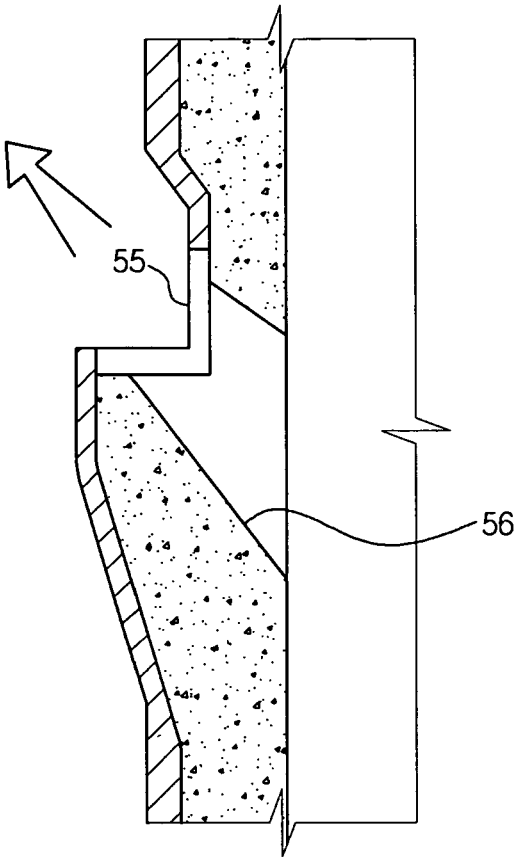
FIG. 7A is a longitudinal-sectional view taken along the line II-II of FIG. 3.

The cool air outlets 55 are configured such that the cool air discharged to the storage chamber 21 through the cool air outlets 55 may be discharged toward the upper portion of the storage chamber 21, as shown in FIG. 7A. For this purpose, a discharge channel 56 provided at the rear of the cool air outlet 55 is inclined downward.

This configuration of the cool air outlets 55 to discharge the cool air toward the upper portion of the storage chamber 21 minimizes visible regions through which a user in front of the storage chamber 21 observes the inside of the cool air duct assembly 50, thereby improving the aesthetics of the cool air duct assembly 50.

Further, the cool air discharged upward at a designated angle relative to the front surface of the storage chamber 21 improves circulation of the cool air in the storage chamber 21, thereby uniformly maintaining the inner temperature of the storage chamber 21.

Figure 7B:
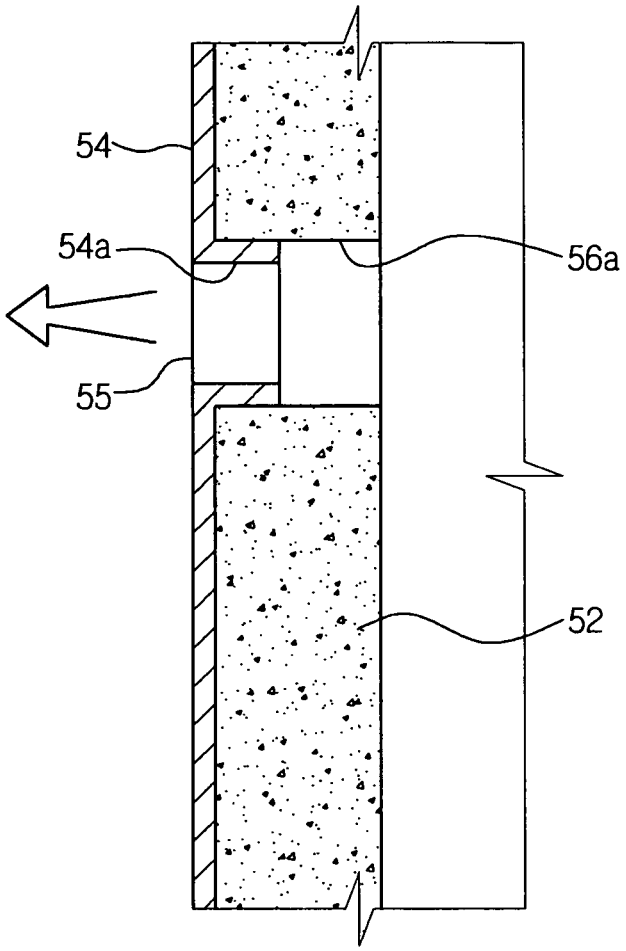
FIG. 7B is a longitudinal-sectional view illustrating a structure of a cool air outlet in accordance with another embodiment.

This embodiment describes that the discharge channels 56 are inclined downward so as to minimize the visible regions through which the user in front of the storage chamber 21 observes the inside of the cool air duct assembly 50, as shown in FIG. 7A. However, if discharge channels 56*a* are disposed horizontally, as shown in FIG. 7B, the front cover 54 surrounding the insulation pad 52 may be provided with flanges 54*a* which is bent so as to surround the front portions of the inner surfaces of the discharge channels 56*a*. This configuration also prevents lowering of the aesthetics of the cool air duct assembly 50 due to exposure of the insulation pad 52 when a user in front of the storage chamber 21 observes the inside of the cool air duct assembly 50 through the cool air outlet 55.

Figure 8:
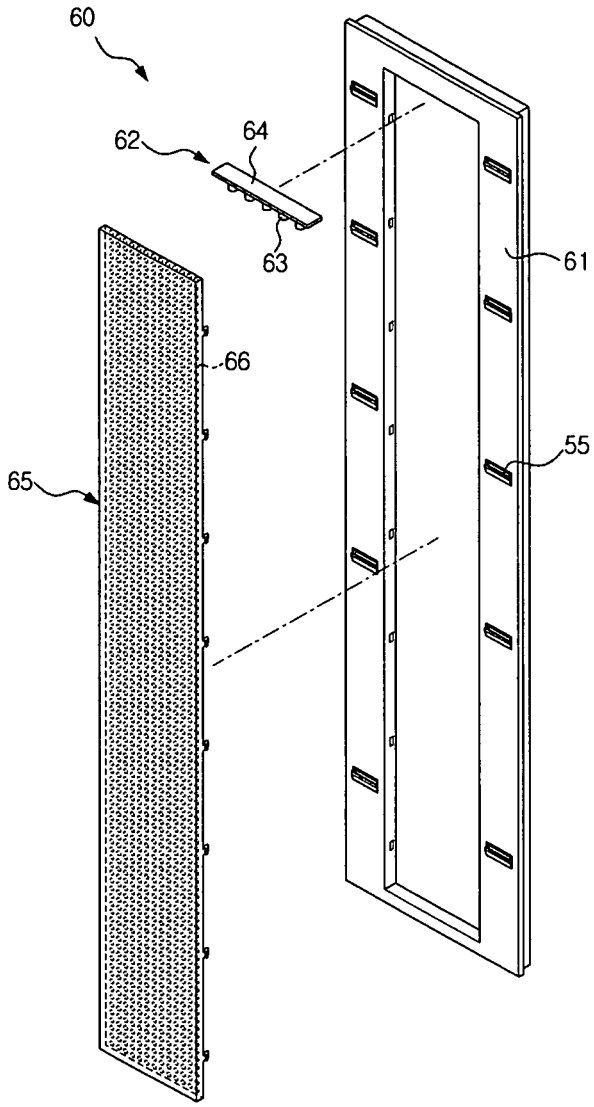
FIG. 8 is an exploded perspective view of an illumination unit in accordance with the embodiment.

With reference to FIGS. 3 and 8, an illumination unit 60 to illuminate the storage chamber 21 is provided at the upper region of the rear portion of the storage chamber 21.

The illumination unit 60 includes an illumination plate 61 fixed to the rear wall of the inner case 15 of the storage chamber 21, a light source 62 supported by the illumination plate 61 to emit light so as to illuminate the inside of the storage chamber 21, and a transparent cover 65 to transmit the light emitted from the light source 62.

The light source 62 includes light emitting diodes 63, and a circuit board 64 on which the light emitting diodes 63 are mounted.

The light source 62 is adhered to one end of the transparent cover 65 so as to irradiate light to the inside of the transparent cover 65.

The transparent cover 65 is made of transparent acryl-based resin so as to diffuse the light, emitted from the light source 62, toward the front portion of the storage chamber 21.

Reflectors 66 to uniformly disperse the light emitted from the light source 62 throughout the transparent cover 65 are provided on the transparent cover 65.

The reflectors 66 are formed in a UV pattern of fine protrusions printed on the rear surface of the transparent cover 65 through an ultraviolet curable printing method.

Through this configuration, the illumination unit 60 has a simple structure as well as prevents glare caused by the light source 62 due to indirect illumination by the transparent cover 65.

Figure 9:
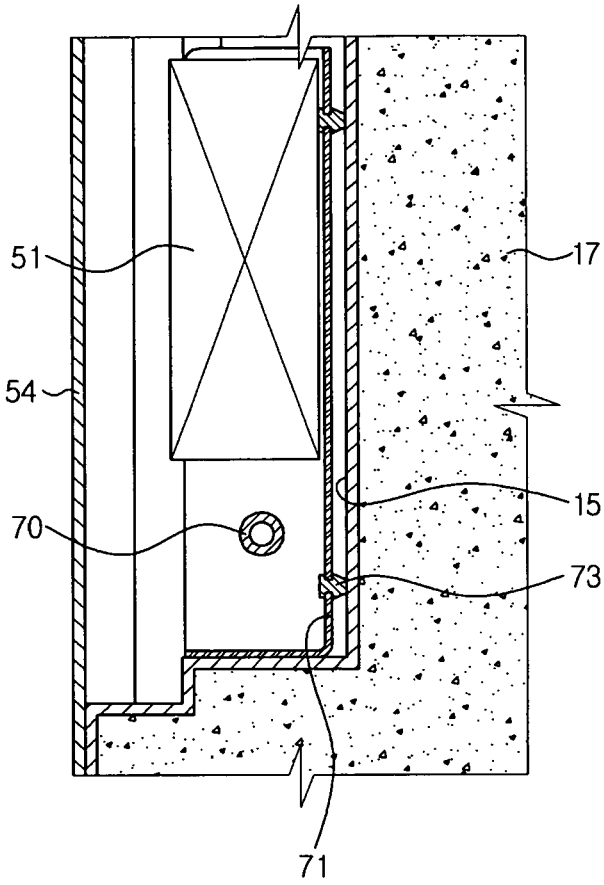
FIG. 9 is a longitudinal-sectional view illustrating a mounting state of a heater cover in accordance with the embodiment.

With reference to FIGS. 3 and 9, a defrosting heater 70 to remove frost formed on the evaporator 51 due to a temperature difference is provided below the evaporator 51.

When power is supplied to the refrigerator, heat generated by a heating part of the defrosting heater 70 is applied to the evaporator 51, thereby removing frost formed on the surface of the evaporator 51.

A heater cover 71 to shield the heat of the defrosting heater 70 is provided between the defrosting heater 70 and the inner case 15.

The heater cover 71, as shown in FIG. 9, is separated from the inner case 15 by a designated distance by a separation member 73.

The separation member 73 prevents heat generated by the defrosting heater from degrading and carbonizing peripheral structures (e.g. the inner case) around the defrosting heater 70 through the heater cover 71.

Figure 10:
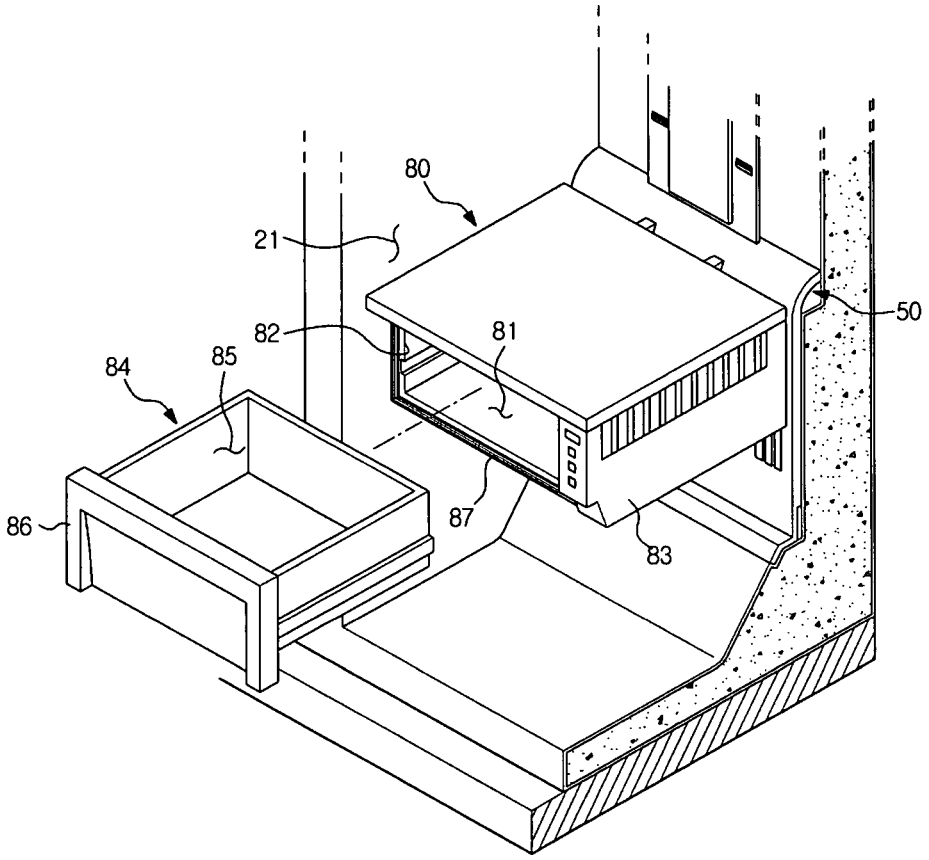
FIG. 10 is a perspective view of a sub-storage chamber in accordance with the embodiment.

With reference to FIG. 10, the sub-storage chamber 80, the temperature of which is controlled separately from the storage chamber 21 through the cool air duct assembly 50, is provided in the lower portion of the storage chamber 21.

The sub-storage chamber 80 includes a housing 83 forming a storage space 81 and provided with an opening 82 formed through the front surface thereof, and a drawer container 84 to move forward and backward installed in the storage space 81 so as to open and close the opening 82.

The drawer container 84 includes a receipt part 85 to receive food, and a cover part 86 disposed on the front surface of the receipt part 85 to open and close the opening 83.

The sub-storage chamber 80 is provided in the refrigerating chamber so as to serve as a thawing chamber to thaw frozen food, or is provided in the freezing chamber so as to serve as a rapid cooling chamber to rapidly cool food.

A gasket 87 to hermetically seal a gap between the drawer container 84 and the housing 83 and to insulate the sub-storage chamber 80 is provided at the edge of the opening 82 of the sub-storage chamber 80. This prevents lowering of the quality of the exterior of the sub-container 80 if the cover part 86 of the drawer container 84 is made of a transparent material.

Through this configuration, the sub-storage container 80 forms the storage space 81 independently of the storage chamber 21, and the storage temperature of the storage space 81 of the sub-storage chamber 80 is independently controlled according to an amount of cool air supplied to the sub-storage chamber 80.

Figure 11:
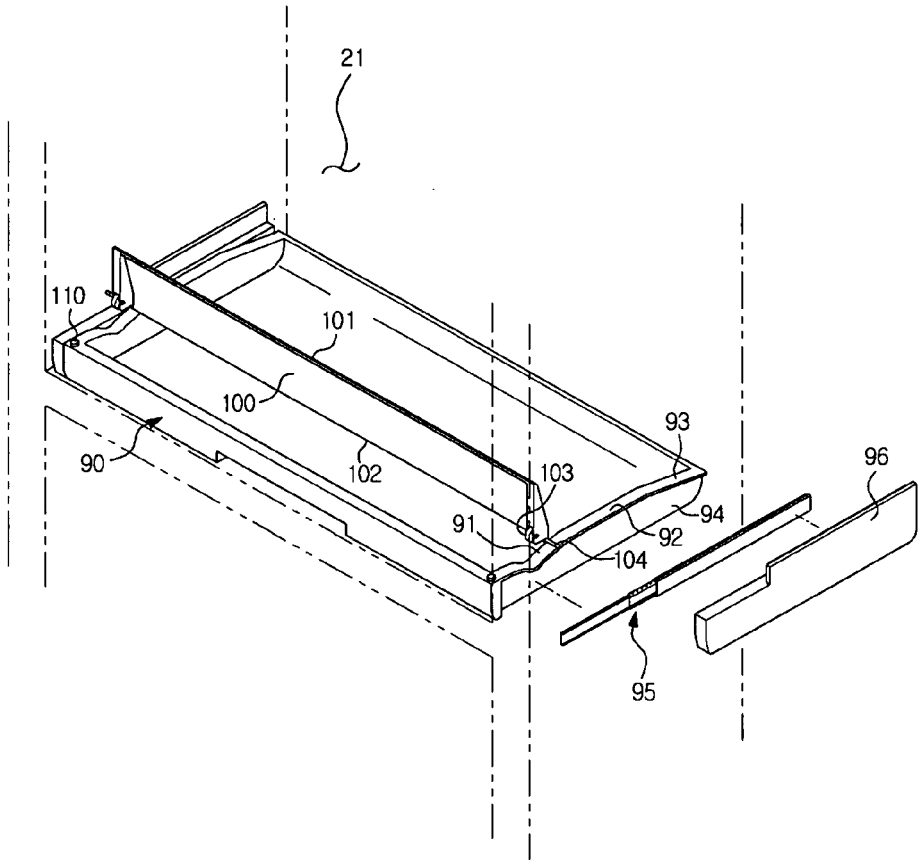
FIG. 11 is a perspective view of a receipt box provided with a cover in accordance with the embodiment.

FIG. 11 is a perspective view of a receipt box of a refrigerator in accordance with another embodiment.

Figure 12A:
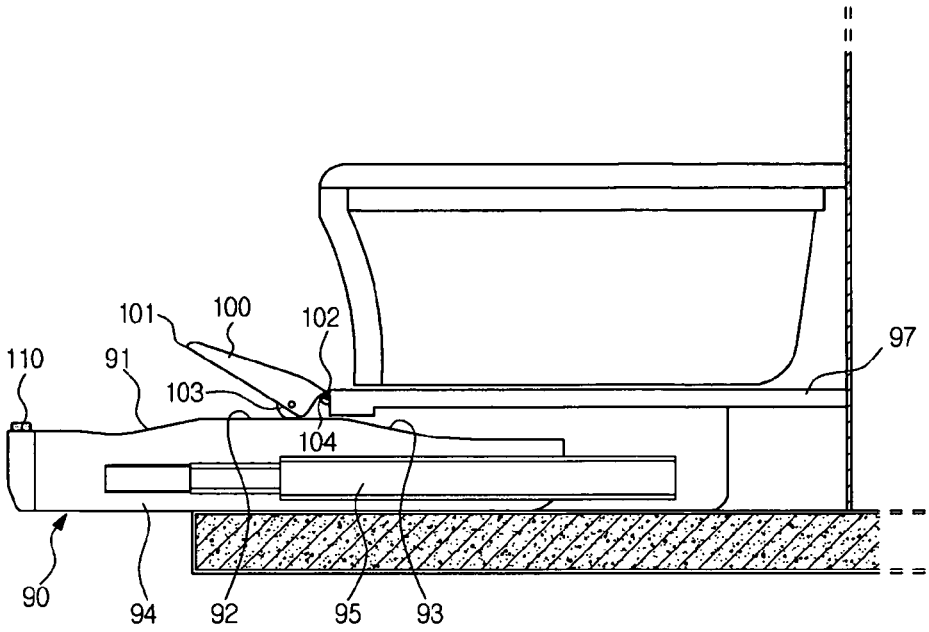
FIG. 12A is a longitudinal-sectional view illustrating an extended state of the receipt box in accordance with the embodiment.

With reference to FIG. 11, a receipt box 90 is slidably installed under a shelf 97 (with reference to FIG. 12A). Rail fixing members 96 to fix three-stage slide rails 95 are installed on both side walls of the storage chamber 21 adjacent to both side surfaces of the receipt box 90.

One surface of each of the three-stage slide rails 95 is connected with one side surface of the receipt box 90, and the other surface of each of the three-stage slide rails 95 is connected with the rail fixing member 96.

The upper portion of the receipt box 90 is opened so as to store food. If the receipt box 90 is inserted into the inside of the storage chamber 21, a part of the opened upper surface of the receipt box 90 is closed by the shelf 97, and the remaining part of the opened upper surface of the receipt box 90 is closed by a cover 100.

The cover 100 is hinged to the shelf 97, and is rotated. A front end 101 of the cover 100 serves as a free terminal and a rear end 102 of the cover 100 is hinged to the shelf 97 and vertically rotated about a rotary shaft 104.

Rolling friction parts 103 are provided on the lower surface of the cover 100, and contact the receipt box 90 to generate friction. The rolling friction parts 103 generate friction with the receipt box 90 when the receipt box 90 is inserted into or extended from the inside of the storage chamber 21.

Various inclined planes are formed in the lengthwise direction on the upper surfaces of both side walls 94 of the receipt box 90 contacting the rolling friction parts 103. The inclined planes formed on the upper surface of one side wall 94 of the receipt box 90 include an upwardly inclined plane 91, a level plane 92, and a downwardly inclined plane 93.

Thereby, when the receipt box 90 is extended from the inside of the storage chamber 21, as shown in FIG. 12A, the rolling friction parts 103 of the cover 100 move along the inclined planes, and thus the cover 100 is rotated upward about the rotary shaft 104.

Figure 12B:
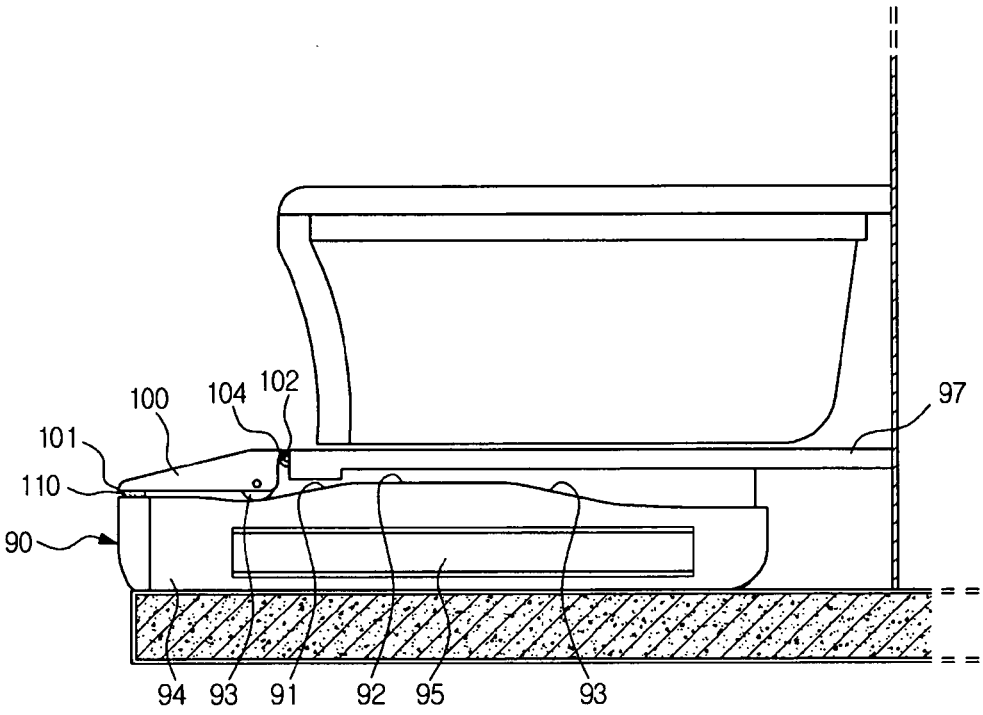
FIG. 12B is a longitudinal-sectional view illustrating an inserted state of the receipt box in accordance with the embodiment.

On the other hand, when the receipt box 90 is inserted into the inside of the storage chamber 21, as shown in FIG. 12B, the cover 100 closes the upper region of the front portion of the receipt box 90. Here, the cover 100 is rotated downward about the rotary shaft 104 by the rolling friction parts 103 moving from the level plane 92 to the upwardly inclined plane 91. Then, the front end 101 of the cover 100 collides with the receipt box 90, and thus may generate noise.

In order to prevent such noise generation, buffering members 110 are provided between the cover 100 and the receipt box 90. The buffering members 110 are provided on the upper surfaces of the front portions of both side walls 94 of the receipt box 90. However, the buffering members 110 may be provided at positions where the cover 100 and the receipt box 90 contact each other.

The buffering members 110 may be rubber pads or pads made of other elastic materials.

Through this configuration, if the receipt box 90 is inserted into the inside of the storage chamber 21, although the cover 100 is rotated downward and collides with the receipt box 90, the buffering members 100 absorb impact applied by the cover 100, thereby reducing noise generation due to collision of the cover 100 with the receipt box 90.

As is apparent from the above description, a refrigerator in accordance with one embodiment increases assembly efficiency of shelves and improves productivity due to reduction of material costs.

Further, the refrigerator in accordance with the embodiment prevents degradation of peripheral structures caused by a heater.

Further, the refrigerator in accordance with the embodiment improved assembly efficiency of a cool air duct.

Moreover, the refrigerator in accordance with the embodiment improves the exterior of a drawer.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body including an inner case forming storage chambers therein;

doors to open and close the storage chambers;

shelves, each of which includes a tempered glass panel on which food is placed, and stopper members provided at both sides of the lower surface of the tempered glass panel;

support ribs provided on both side walls of the storage chambers so as to support both sides of the shelves, each support rib including a front rib, a rear rib, and a latch groove provided between the front rib and the rear rib such that each stopper member is inserted into the latch groove; and inclination prevention ribs, each of which is provided above the rear rib and supports the upper surface of each shelf to prevent each shelf seated on the support ribs from being inclined forward.

2. The refrigerator according to claim 1, wherein the length of the latch groove is greater than the width of each stopper member so as to allow each stopper member to move forward and backward within the latch groove.

3. The refrigerator according to claim 2, wherein if each stopper member moves to a front end of the latch groove, the corresponding shelf is separable from the support ribs, and if each stopper member moves to a rear end of the latch groove, the rear end of the corresponding shelf is supported by the inclination prevention ribs and thus the corresponding shelf is mounted in the storage chamber.

4. The refrigerator according to claim 1, further comprising an illumination unit including a light source to illuminate each storage chamber and a transparent cover to transmit light emitted from the light source, wherein reflectors formed through an ultraviolet curable printing method are provided on the transparent cover.

5. The refrigerator according to claim 1, further comprising an evaporator generating cool air to supply the cool air to each storage chamber, wherein a defrost heater to remove frost formed on the evaporator, a heater cover installed on the inner case to block heat generated by the defrost heater, and a separation member to separate the heater cover from the inner case so as to prevent carbonization of the inner case caused by the heater cover are provided.

6. The refrigerator according to claim 1, wherein the stopper members are fixed to the tempered glass panel through an adhesive agent.

7. The refrigerator according to claim 1, wherein each shelf further includes a front frame made of resin and surrounding the front edge of the tempered glass panel, and the surface of the front frame is coated with a film made of metal.

8. The refrigerator according to claim 7, wherein the front frame is made of Acrylonitrile Butadiene Styrene (ABS), and the film is made of aluminum.

9. The refrigerator according to claim 1, further comprising:

an evaporator generating cool air to supply the cool air to each storage chamber; and a cool air duct assembly to supply the cool air generated by the evaporator to each storage chamber, wherein the cool air duct assembly includes an insulation pad provided with a channel, a front cover to cover the front surface of the insulation pad, an air blower fan disposed in the channel, and a mount part to fix the air blower fan is formed integrally with the insulation pad.

10. The refrigerator according to claim 1, further comprising a sub-storage chamber disposed in one of the storage chambers such that the temperature of the sub-storage chamber is controlled independently of the one of the storage chamber, wherein the sub-storage chamber includes a housing forming a storage space and provided with an opening formed through the front surface thereof, and a drawer container to move forward and backward installed in the storage space so as to open and close the opening, and a gasket is provided around the opening.

11. The refrigerator according to claim 1, further comprising cool air outlets through which cool air generated by an evaporator of each storage chamber is discharged, wherein the cool air outlets are configured such that the cool air discharged to each storage chamber through the cool air outlets is directed to the upper portions of each storage chamber.

12. The refrigerator according to claim 11, wherein discharge channels, each of which is provided at the rear of each cool air outlet, are inclined downward.

13. The refrigerator according to claim 1, further comprising:

a front cover provided with cool air outlets through which cool air generated by an evaporator of each storage chamber is discharged; and discharge channels, each of which is provided at the rear of each cool air outlet, wherein the front cover is provided with flanges which is bent so as to surround the front portions of the inner surfaces of the discharge channels.

14. The refrigerator according to claim 1, wherein hook holes are provided at both sides of the tempered glass panel, and the stopper members are hooked to the hook hole and thus fixed to each shelf.

15. A refrigerator, which includes storage chambers, a receipt box installed on each storage chamber so as to be extended from and inserted into the inside of each storage chamber, and a cover contacting upwardly inclined surfaces of upper ends of both side walls of the receipt box and rotated upward and downward about a rotary shaft so as to open the upper portion of the receipt box when the receipt box is extended from the inside of each storage chamber, and to close the upper portion of the front region of the receipt box when the receipt box is inserted into the inside of each storage chamber, comprising:

buffering members to prevent noise generated due to collision of the cover with the receipt box when the cover is rotated downward so as to close the receipt box.

16. The refrigerator according to claim 15, wherein the buffering members include pads made of an elastic material.

17. The refrigerator according to claim 16, wherein the buffering members are located at positions where the cover and the receipt box contact each other.

* * * * *